United States Patent [19]

Logvinov et al.

[11] Patent Number: 4,519,437

[45] Date of Patent: May 28, 1985

[54] CASTING-BY-SQUEEZING MOLD

[76] Inventors: Anatoly A. Logvinov, 7-ya Parkovaya, 27, kv. 52; Vladimir N. Milov, Krivorozhskaya, 21, korpus 2, kv. 67; Nikolai S. Ostrenko, Kosinskaya ulitsa, 26, korpus 1, kv. 64; Nikolai A. Demyanovich, 1-y Goncharny pereulok, 7, kv. 108, all of Moscow; Vladimir A. Antonov, Moldavskaya SSR, ulitsa Sredko, 14, kv. 63, Tiraspol; Fen Z. Abdulin, ulitsa Kuznetsova, 6, kv. 35, Ulyanovsk; Oleg S. Berdiev, ulitsa Sadovaya, 34, kv. 8, Arseniev, Primorsky krai, all of U.S.S.R.

[21] Appl. No.: 391,123

[22] Filed: Jul. 23, 1982

[51] Int. Cl.[3] ..... B22D 17/00

[52] U.S. Cl. ..... 164/284; 164/342

[58] Field of Search ..... 164/319-321, 164/284, 120, 113, 133, 136, 340, 342, 312

[56] References Cited

U.S. PATENT DOCUMENTS

| | | | |
|---|---|---|---|
| 2,521,520 | 9/1950 | Jancura | 164/342 X |
| 3,106,002 | 10/1963 | Bauer | 164/320 |
| 3,270,383 | 9/1966 | Hall et al. | 164/120 |
| 4,301,856 | 11/1981 | DiRosa | 164/342 X |

*Primary Examiner*—Kuang Y. Lin

*Attorney, Agent, or Firm*—Murray Schaffer

[57] ABSTRACT

A casting-by-squeezing mold having a base, mold halves, and enclosing cheeks. One of the mold halves is movably mounted on the base so that the two mold halves can be driven apart and brought together to form a complete mold. The internal surfaces of the base, mold halves and cheeks form a cavity. One of the mold halves has projections which divide it into three chambers. The first, lower chamber is a metal receiving chamber; the second, side chamber is a feeding chamber; the third, central chamber is a molding chamber. A variable-volume cavity is provided, which communicates with the metal receiving chamber so that the level of the metal in the receiving chamber can be adjusted to a predetermined level.

3 Claims, 5 Drawing Figures

CASTING-BY-SQUEEZING MOLD

FIELD OF THE INVENTION

The present invention relates to metallurgy and, more particularly, to foundry practice. Still more specifically, the invention relates to molds for casting by squeezing and is best applicable to the production of large-size panel- or shell-like castings which may be provided with strengthening ribs and brackets.

The invention has extensive application in the aircraft and ship-building industries and in the production of critical parts possessing excellent mechanical properties. Finally, the invention is useful in to the fabrication of different types of doors, including trap doors, different types of cabins, including lift cabins (elevator cars), and different types of vessels and containers, such as gasoline and oil drums, tanks and cylinders.

BACKGROUND OF THE INVENTION

During the past ten years, casting by squeezing has been extensively used for the production of large-size castings with a wall thickness of 2 to 5 mm which is about the wall thickness of the finished part or item.

The basic principle of casting by squeezing is as follows. As mold halves or parts of a split-type mold are brought together, most of the melt filling the metal receiving chamber is forced through the feeding chambers into the molding chamber where the casting is produced.

The quality of the casting thus produced is largely dependent on the level of molten metal in the molding chamber and the speed at which it is driven into that chamber at any given moment of time during the period when the mold halves are brought together. Thus the quality of the casting is largely dependent on the level of molten metal in the metal receiving chamber just before the mold halves are brought together. Deviation in the level of melt in the metal receiving chamber from an optimum value are due to imperfections in the melt feeding system and a change of the cubic content of the metal receiving chamber which may occur during its service life.

Casting by squeezing is done in molds comprising detachable parts which include a flat or cylindrical base and mold halves at least one of which is mounted on the base so that it can move along the base or in the radial direction without losing contact with the base. Thus the mold halves can be driven apart and brought together. The detachable parts of the mold also include cheeks adjacent to the base and mold halves in the zone of their parting line. The internal surfaces of the base, mold halves and cheeks form a chamber in at least one of the mold halves, which is divided by projections into a lower, metal-receiving chamber, side, feeding chambers and a central, molding chamber. The chambers communicate with one another. For the production of shell-type castings, the base is provided with a special core (cf. V. N. Vinogradov, "Liteyniye formy dlya tsvetnykh splavov"/"Casting Molds for Non-Ferrous Alloys"/, Machinostroyeniye Publishers, Moscow, 1981, pp. 35 and 37).

In a casting machine, the base of the split-type casting mold is secured in the center on the bed. The mold halves are mounted on cross-pieces coupled to the end supports of the bed by means of guides and drives for driving the mold halves apart and bringing them together. In order to seal the parting line between the mold halves and the bed, the cheeks are mounted on one of the mold halves or on additional supports provided on the bed so that said cheeks can be set in reciprocating or angular motion. The drive, by means of which the mold halves move on the cross-pieces, is provided with a locking means. The latter is put into operation when the mold halves are brought into abutting, or end-to-end, relation. If both mold halves are movable the drive is provided with a means for synchronizing their movement. The drive is also provided with a special device to control the speed at which the mold halves are brought together.

The level of melt in the metal receiving chamber is controlled with the aid of calibrated ladles and different devices, such as magnetodynamic proportioners.

The time lag of such devices and the build-up of metal are factors which affect the accuracy of proportioning. Another such factor is a change of the volume of the metal receiving chamber which is due to build-up of metal, wear of the lining, and periodic expansion and compression of its walls as they are heated and cooled during operation. Until recently, it has been impossible to have a level of melt in the metal receiving chamber just before the mold halves are brought together, which would ensure a desired level of melt in the molding chamber and the rate at which it is forced into that chamber, i.e., would satisfy the conditions essential for the production of high-quality castings with a high-strength, homogeneous, structure.

SUMMARY OF THE INVENTION

It is an object of the present invention to provide a casting-by-squeezing mold which would make it possible to produce high-quality, high-strength castings of a homogeneous structure by ruling out the effects of differences between the actual amount of melt and its specified amount and the effects of change of the volume of the metal receiving chamber on the level of melt in the metal receiving chamber just before the mold halves are brought together.

It is another object of the invention to provide a compact casting mold of a simple design.

It is still another object of the invention to provide a casting mold which would speed up and facilitate the removal of castings.

It is yet another object of the invention to provide a casting mold which would improve the structure of cast metal and make it consistently homogeneous.

The foregoing and other objects of the present invention are attained by providing a casting-by-squeezing mold comprising detachable parts which include a base, mold halves at least one of which is movably mounted on the base so that the mold halves can be driven apart and brought together, and cheeks arranged in the zone of the parting line of the mold halves, the internal surfaces of the base, mold halves and cheeks forming a cavity which is divided by projections in at least one of the mold halves into a lower, metal receiving chamber, side, feeding, chambers, and a central, molding chamber, the mold being characterized, according to the invention, in that it has at least one variable-volume cavity communicating with the metal receiving chamber.

The variable volume cavity, which communicates with the metal receiving chamber, ensures a desired level and flowrate of melt in the molding chamber and eliminates fluctuations of the melt level in the metal receiving chamber just before the mold halves are brought together, which may be due to the pouring of an excessive or insufficient amount of melt and to changes of the volume of the metal receiving chamber. The mold of this invention improves the physical-chemical properties and structural homogeneity of castings.

It is preferable that the variable-volume cavity be a recess in the wall of the metal receiving chamber, which recess communicates with the metal receiving chamber and which recess accommodates a piston.

As a result, the mold is compact and simple in design.

It is preferable that the recess with the piston should be made in the wall of the movable mold half, and that the generatrices of the interacting surfaces of the recess and the piston should extend in the direction of movement of the mold halves as these are driven apart.

When a casting is produced in the molding chamber, the mold halves are easily driven apart and the casting is removed in the conventional manner.

BRIEF DESCRIPTION OF THE DRAWINGS

Other objects and advantages of the present invention will become more apparent from a consideration of the following detailed description of preferred embodiments thereof, taken in conjunction with the accompanying drawings, wherein.

DESCRIPTION OF THE PREFERRED EMBODIMENTS

Figure 1:
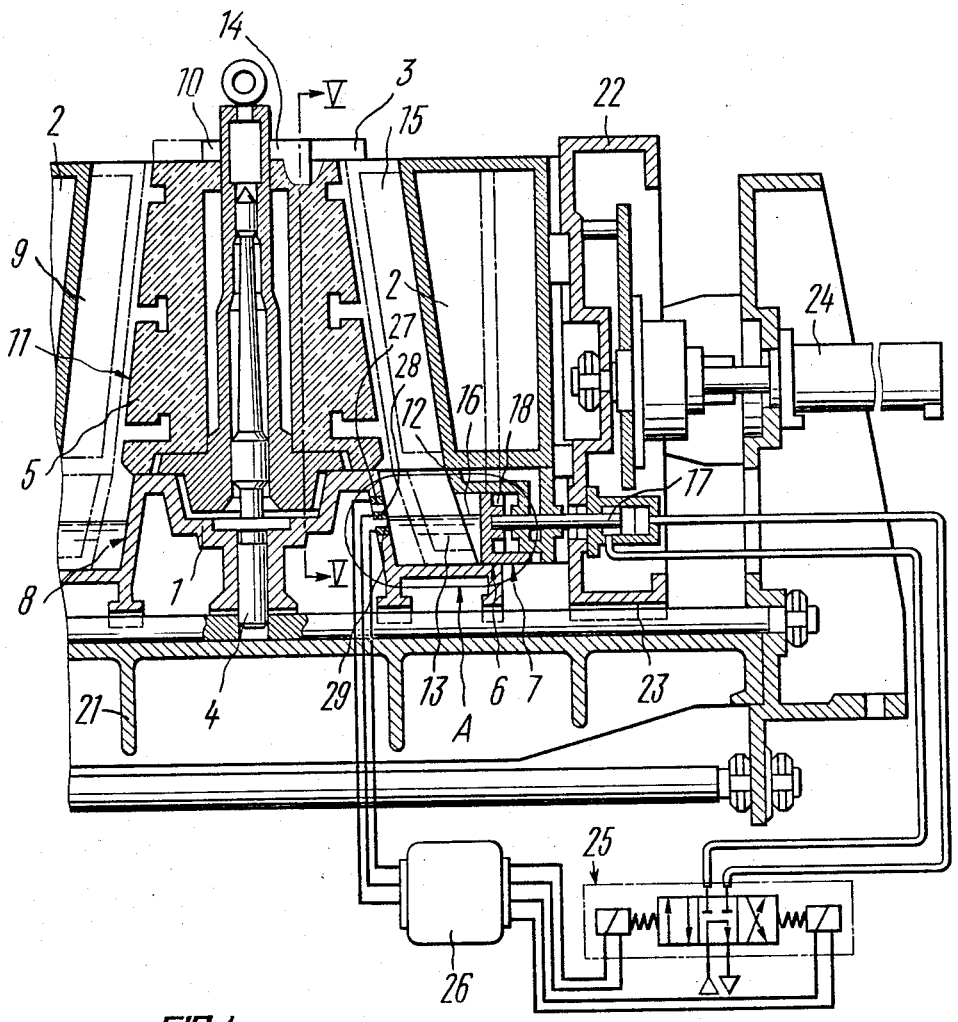
FIG. 1 is an elevation view of a mold in accordance with the invention, installed In a casting-by-squeezing machine complete with a core; solid lines show the mold halves driven apart; dot-and-dash lines show the mold halves brought together.

Consider preferred embodiments of a casting-by-squeezing mold in accordance with the invention, its operating principle, and operation of some of its components functioning either independently or in conjunction with parts and units of a casting-by-squeezing machine.

An accurate description of operation of the casting-by-squeezing mold according to the invention would be impossible without referring to certain parts and components of the casting machine in which the mold is installed. These parts and components are well known to those skilled in the art and will not be described in great detail for the sake of simplicity.

The casting-by-squeezing mold according to the invention is composed of detachable parts which include a base 1 (FIG. 1), mold halves 2 and cheeks 3. A lock pin 4 is used to install a core 5 in the center of the base 1 for the production of shell-type castings. No core is used in the production of panel-type castings (see FIG. 4). Both mold halves 2 or at least one of them (FIG. 4) are movable on the base 1 without loosing contact with the base 1; as a result, the mold halves 2 can be driven apart and brought together. Interacting surfaces 6 and 7 of the base 1 and mold halves 2, respectively, are flat (FIG. 1) if the mold halves 2 or at least one of them move along a straight line as they are driven apart or brought together. The surfaces 6 and 7 are cylindrical (FIG. 4) if the mold halves 2 or at least one of them proceed along a circular path as they are driven apart or brought together. The cheeks 3 are firmly in contact with the base 1 and mold halves 2 in the zone of their parting line. Internal walls 8, 9, 10 and 11 of the base 1, mold halves 2, cheeks 3 and rod 5 (if such is used), respectively, from an enlarged chamber. The surfaces of one or the other mold halves is provided with at least two essentially longitudinal projections 12, which do not extend as far as the base and which divide the chamber in the longitudinal direction, and an essentially transverse projection 12 which connects the lower ends of said longitudinal projections. The projections dividing, in their combination, the chamber into smaller chambers, the first of which is a lower chamber 13 between the base and the transverse projection serving as a metal receiving chamber, the second is on the internal side of the longitudinal projections serving as a central, or molding, chamber 15, while the others are on the outside of the projections and serve as feeding chambers 14.

The wall 8 of the base 1, the walls 9 of the mold halves 2, and the walls 10 of the cheeks 3 facing the mold interior define in combination a cavity having a section varying in height and along the parting line of the mold halves. The projections 12 provided on the wall 9 of at least one of the mold halves 2 divide the mold cavity, as is clearly shown with the mold halves 2 fully closed, into a plurality of component chambers of different cross-sectional area and function—a metal receiving chamber 13, at least two feeding chambers 14, and one molding chamber 15.

Figure 5:
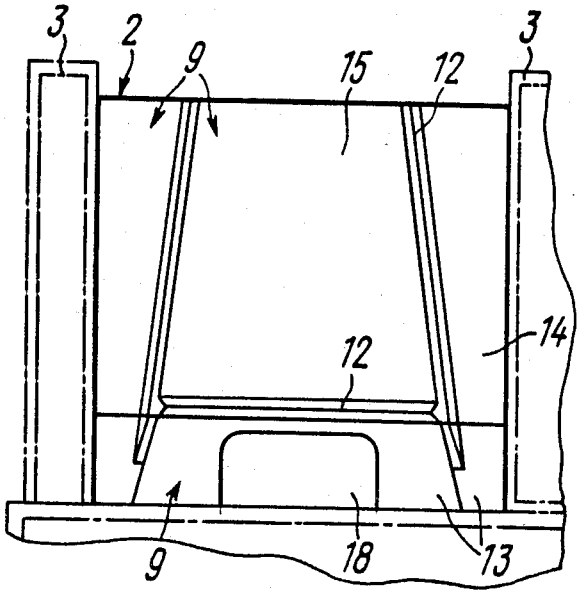
FIG. 5 is a simplified view taken in the direction of line V—V of FIG. 1, showing the longitudinal and transverse projections dividing the cavity into several chambers.

The metal receiving chamber 13 is located directly over the base 1 in the zone of the joint of the mold halves 2. The central, molding chamber 15 occupies the central zone of the mold cavity directly over the chamber 13. Each of the feeding chambers 14 occupies the peripheral zone of the mold cavity over the chamber 13 and between the cheek 3 and the central, molding chamber 15. Moreover, as seen in FIG. 5, the central molding chamber 15 is surrounded by two side projections extending vertically or almost vertically, separating the molding chamber 15 from the peripheral feeding chamber 14. The remaining, lower projection 12 extends horizontally or almost horizontally and separating the molding chamber 15 from the metal receiving chamber 13. Even with the mold halves fully closed, however, the molding chamber 15 communicates with the chambers 13 and 14 through slit-like passages over each of the projections 12 in the plane of the joint of the mold halves 2. Each of the feeding chambers 14 communicates in the bottom part thereof directly with the metal receiving chamber 13.

Figure 2:
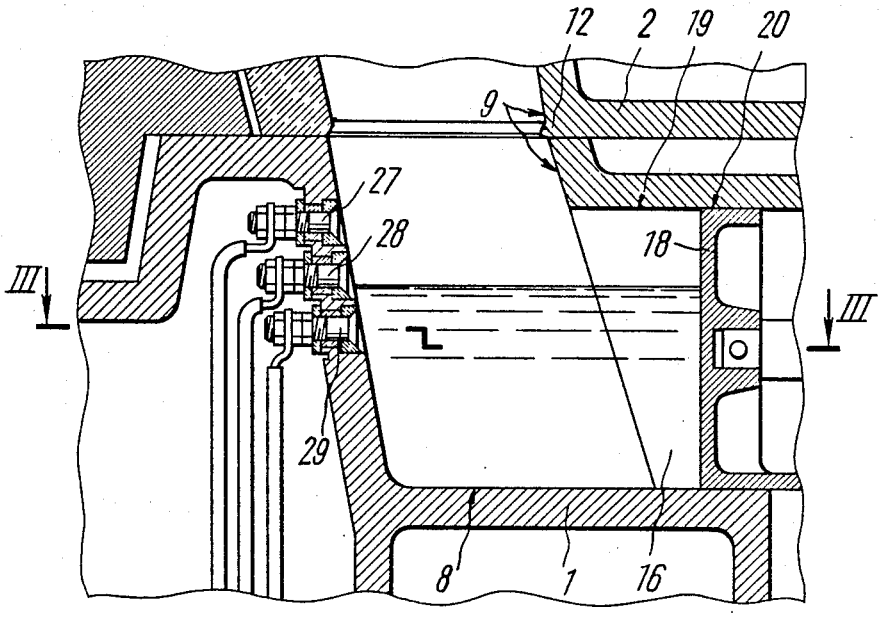
FIG. 2 is a magnified view of unit A in FIG. 1.
Figure 3:
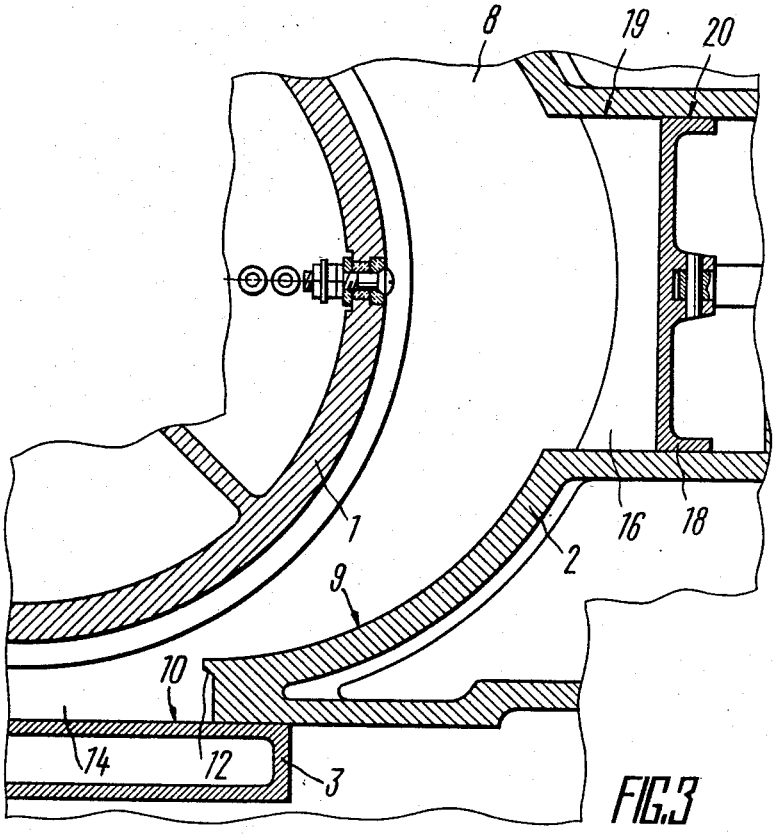
FIG. 3 is a horizontal section taken on line III—III of FIG. 2.

The mold of this invention contains at least one variable-volume cavity 16 (FIGS. 2 and 3) communicating with the metal receiving chamber 13. The cavity 16 is a recess which is made in the wall 9 and accommodates a piston 18 driven by a drive 17. The generatrix of the surface of the recess extends in the direction of movement of the movable mold half 2 as it is brought to the stationary mold half 2. The piston 18 changes the volume of the cavity 16 which, as is mentioned above, communicates with the metal receiving chamber 13.

Figure 4:
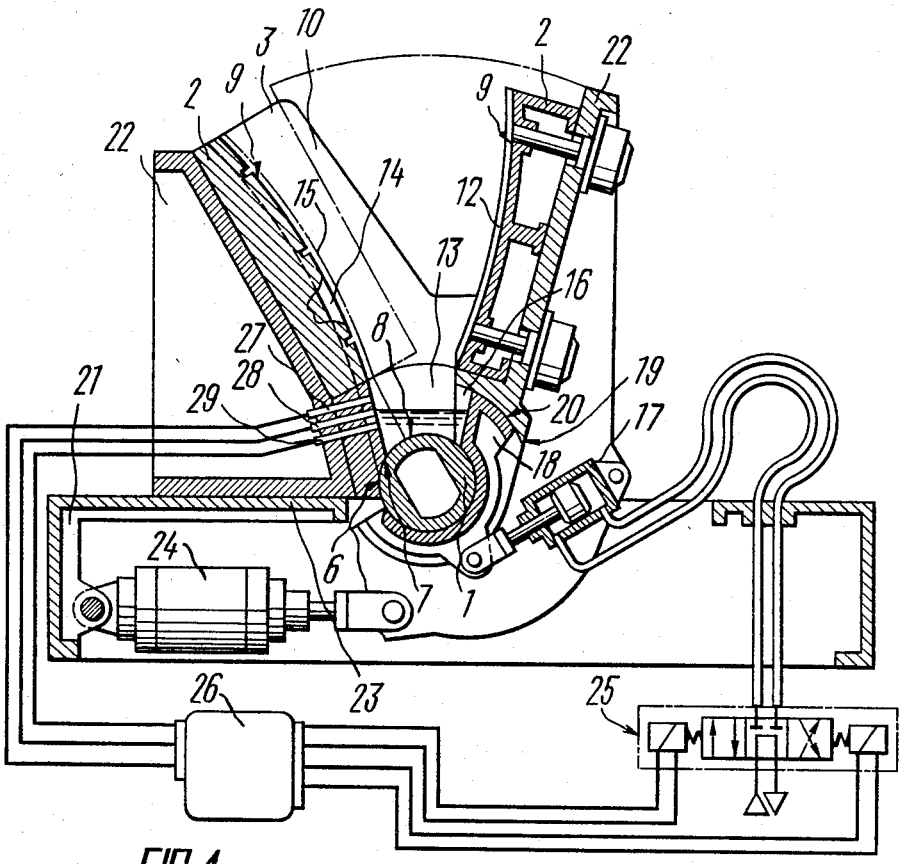
FIG. 4 is an elevation view of a mold in accordance with the invention with a movable mold half; the mold is installed in a casting-by-squeezing machine without a core, in which the mold halves proceed along a circular path as they are brought together; solid lines show the mold halves driven apart with melt poured into the metal receiving chamber; dot-and-dash lines show the mold halves brought together

FIGS. 1 and 4 both show only one variable-volume cavity, but it is understood that one can use more than one cavity. Similar cavities may be made in the walls 8 and 10 of the base 1 and/or mold halves 2 and/or cheeks 3 as grooves accommodating pistons provided with drives the way it is shown in FIGS. 1, 2, 3 and 4. According to the attached drawings, the variable-volume cavity is cylinder-shaped, but other configurations are also possible. In order to facilitate the removal of finished castings, cavities 16 should preferably be made in the walls 9 of the movable mold half 2. The generatrices of surfaces 19 of the cavities 16 and those of surfaces 20 of the pistons 18, which interact with the cavities 16, should extend in the direction of movement of the movable mold halves 2 (FIGS. 1 and 4). Instead of pistons, one can use flexible or elastic membranes of any device which makes it possible to vary the volume of the cavity 16.

In a casting machine where the mold halves are driven apart and brought together along a straight line, the interacting surfaces 6 and 7 of the base 1 and the movable mold half 2, respectively, are flat (FIG. 1).

If the mold halves are driven apart and brought together along a circular path, the interacting surfaces of the base 1 and the movable mold half 2 are cylinder-shaped (FIG. 4).

Irrespective of the kind of path along which the mold halves are driven apart and brought together, the base 1 of the casting-by-squeezing mold is mounted in the center of a bed 21, and the mold halves are mounted on crosspieces 22. At least one of the crosspieces 22 is to be coupled to the bed 21 by means of a movable joint 23 and drives 24. The other crosspieces are coupled to the bed either rigidly or in the above manner. The cheeks 3 are mounted either on the bed 21 or on the mold halves 2. The cheeks 3 are coupled to the bed 21 or mold halves 2 either rigidly or by means of a movable joint so that they can be set in motion by a drive (not shown).

The mold halves 2 and crosspieces 22 are driven by drives 24 whose power supply circuits incorporate means to control the speed at which the mold halves are brought together and synchronize the movement of the mold halves in case both mold halves are movable (not shown).

If the cavity 16 is made in the wall of the movable mold half 2, the drive 17 of the piston 18 is mounted either on the mold half 2 or on the crosspiece 22. The drive 17 is controlled by a control valve 25 according to instructions received from a comparator 26 connected to melt level gauges 27, 28 and 29 arranged on at least one of the walls 8, 9 and 10 of the metal receiving chamber 13. The gauge 28 is located at a specified melt level; the gauge 27 is above the gauge 28, and the gauge 29 is below.

The casting-by-squeezing mold according to the invention operates as follows.

The drives 24 bring the mold halves 2, which are mounted on the crosspieces 22, to their initial position. The cheeks 3 seal the parting line between the mold half 2 and base 1. A specified amount of melt is ladled or piped to the metal receiving chamber 13 and kept there for a certain period of time. Shortly before the mold halves 2 are brought together, the level gauges measure the level of melt in the metal receiving chamber 13. If the level of melt is above the location of the gauge 27 the comparator 26 sends an instruction to the control valve 25, and the drive 17 moves the piston 18 so as to increase the volume of the cavity 16 communicating with the metal receiving chamber 13. The piston 18 is driven until the melt level in the metal receiving chamber 13 is brought down to the level of the gauge 28. It the level of melt in the metal receiving chamber 13 is as low as the location of the gauge 29 the comparator 26 sends an instruction whereby the piston 18 is driven in the oppposite direction.

When the level of melt in the metal receiving chamber 13 is as required, the drive 17 is switched off, and the drives 24 receive an instruction from the speed control means (not shown) to bring the mold halves 2 together. When this is done, the melt flows from the metal receiving chamber 13 through the side, feeding, chamber 14 to the molding chamber 15. Maintaining the melt strictly at a specified level in the metal receiving chamber 13 accounts for a strict relationship between the flowrate of the melt and its level in the mold at any given instant. The mold halves 2 are kept in a locked state until the melt crystallizes and the casting is somewhat cooled.

The mold halves 2 are then driven apart and the finished coating is removed.

Maintaining the melt in the metal receiving chamber strictly at a desired level is extremely important in that each time the molding chamber is filled with melt exactly under the same conditions. The absence of deviations of hydraulic parameters accounts for a consistently high quality of castings.

While particular embodiments of the invention have been shown and described, various modifications thereof will be apparent to those skilled in the art and therefore it is not intended that the invention be limited to the disclosed embodiments or to details thereof and departures may be made therefrom within the spirit and scope of the invention as defined in the appended claims.

What is claimed is:

1. A squeeze-casting mold comprising a base, a pair of mold halves, a core at least one of said mold halves being movable toward and away from said other mold halve between a closed and open position, to form therewith when closed at least one molding chamber and when both open or closed at least one metal receiving chamber communicating with said molding chamber, at least two substantial longitudinal projections on the walls of at least one of said mold halves, and at least one substantially transverse projection on one of said mold halves which connects the lower ends of said longitudinal projections, said projections dividing said molding chamber into a lower chamber between the base and the transverse projection serving as the metal receiving chamber, and an upper chamber on the internal side of the longitudinal projections and surrounding cheeks enclosing the side and upper edges of said mold, a cavity formed in at least one of said mold halves communicating with said metal receiving chamber, said cavity having means for adjusting the volume thereof when said metal receiving chamber is initially filled, to thereby enable adjustment of the level of metal in said metal receiving chamber.

2. The mold according to claim 1 including means for sensing the level of metal in said metal receiving chamber and adjusting the volume of said cavity to maintain a predetermined level.

3. The mold according to claim 1 wherein one wall of said cavity is a hydraulically driven piston.

* * * * *